US008477957B2

(12) United States Patent
Kelloniemi et al.

(10) Patent No.: US 8,477,957 B2
(45) Date of Patent: Jul. 2, 2013

(54) APPARATUS, METHOD AND COMPUTER PROGRAM

(75) Inventors: Antti Pekka Kelloniemi, Helsinki (FI); Jouni Veikko Knuuttila, Espoo (FI)

(73) Assignee: Nokia Corporation, Espoo (FI)

( * ) Notice: Subject to any disclaimer, the term of this patent is extended or adjusted under 35 U.S.C. 154(b) by 605 days.

(21) Appl. No.: 12/386,308

(22) Filed: Apr. 15, 2009

(65) Prior Publication Data

US 2010/0266136 A1 Oct. 21, 2010

(51) Int. Cl.
*G10K 11/16* (2006.01)

(52) U.S. Cl.
USPC ..... 381/71.6

(58) Field of Classification Search
USPC ..... 381/71.1–71.14
See application file for complete search history.

(56) References Cited

U.S. PATENT DOCUMENTS

| | | | | |
|---|---|---|---|---|
| 3,985,960 | A | 10/1976 | Wallace, Jr. | 179/1 G |
| 4,455,675 | A | 6/1984 | Bose et al. | 381/74 |
| 5,027,410 | A | 6/1991 | Williamson et al. | 381/68.4 |
| 5,251,263 | A | 10/1993 | Andrea et al. | 381/71 |
| 5,504,805 | A | 4/1996 | Lee | 379/67 |
| 5,792,073 | A | 8/1998 | Keefe | 600/559 |
| 6,139,507 | A | 10/2000 | Jeng | 600/559 |
| 6,415,034 | B1 * | 7/2002 | Hietanen | 381/71.6 |
| 6,567,524 | B1 * | 5/2003 | Svean et al. | 381/71.1 |
| 6,837,857 | B2 | 1/2005 | Stirnemann | 600/559 |
| 6,937,738 | B2 | 8/2005 | Armstrong et al. | 381/312 |
| 2007/0195963 | A1 | 8/2007 | Ko et al. | 381/26 |
| 2007/0291953 | A1 | 12/2007 | Ngia et al. | 381/71.6 |
| 2009/0016541 | A1 * | 1/2009 | Goldstein et al. | 381/57 |
| 2009/0034765 | A1 | 2/2009 | Boillot et al. | 381/309 |
| 2009/0147966 | A1 * | 6/2009 | McIntosh et al. | 381/71.11 |

OTHER PUBLICATIONS

Engebretson, A. Maynard et al., "Sound Synthesizer and Acoustic Measurement System for Psychoacoustic Research", 1991, pp. 1893-1894, Annual International Conference of the IEEE Engineering in Medicine and Biology Society, vol. 13, No. 4.

Riikonen, V. et al., "An Augmented Realty Audio Mixer and Equalizer", May 17-20, 2008, pp. 1-8, Audio Engineering Society Convention paper.

* cited by examiner

*Primary Examiner* — Khanh V Nguyen
(74) *Attorney, Agent, or Firm* — Harrington & Smith

(57) ABSTRACT

An apparatus, method and computer program, the apparatus including includes a housing configured to be positioned in a user's external ear, a loudspeaker located at a first position within the housing and configured to provide an acoustic signal, a microphone configured to detect an acoustic signal located at a second position within the housing, a filter configured to filter an input signal provided to the loudspeaker; and a controller configured to enable the acoustic signal detected by the microphone to be used to provide a control signal to the filter.

19 Claims, 4 Drawing Sheets

APPARATUS, METHOD AND COMPUTER PROGRAM

FIELD OF THE INVENTION

Embodiments of the present invention relate to an apparatus, method and computer program. In particular, they relate to an apparatus, method and computer program for providing an acoustic signal.

BACKGROUND TO THE INVENTION

Apparatus which provide acoustic signals, such as earphones are well known. When such apparatus are used the earphones are located adjacent to or within a user's ear so that the acoustic signal provided by the earphone may be provided directly into the ear canal of the ear.

It is useful to ensure that such apparatus give a consistent level of performance.

BRIEF DESCRIPTION OF VARIOUS EMBODIMENTS OF THE INVENTION

According to various, but not necessarily all, embodiments of the invention there is provided an apparatus comprising: a housing configured to be positioned in a user's external ear; a loudspeaker located at a first position within the housing and configured to provide an acoustic signal; a microphone configured to detect an acoustic signal located at a second position within the housing; a filter configured to filter an input signal provided to the loudspeaker; and a controller configured to enable the acoustic signal detected by the microphone to be used to provide a control signal to the filter.

In some embodiments of the invention the second position may be displaced from the first position so that, in use, the microphone may be positioned between the loudspeaker and an ear drum.

In some embodiments of the invention the microphone may be configured to convert the detected acoustic signal into an electrical signal and provide the electrical signal to the controller.

In some embodiments of the invention the acoustic signal detected by the microphone may comprise a plurality of components including the acoustic signal provided by the loudspeaker and an acoustic signal reflected by an ear canal and ear drum. The acoustic signal detected by the microphone may comprise a plurality of frequency components from the audible frequency range including low and mid frequency components as well as high frequency components. The controller may be configured to use the electrical signal provided by the microphone to give an indication of individual characteristics of the user's ear.

In some embodiments of the invention the controller may be located within the housing.

In some embodiments of the invention the apparatus may comprise a further microphone configured to detect an acoustic signal located at a third position where the third position is displaced from the first position such that, in use, the further microphone is positioned between the loudspeaker and an external environment external to the user's ear.

In some embodiments of the invention the apparatus may comprise a feedback circuit which may be used to control the acoustic signal provided by the loudspeaker.

In some embodiments of the invention the output signal of the microphone may be provided to the feedback circuit.

In some embodiments of the invention the controller may also be configured to use signals detected by the microphone for active noise cancellation.

In some embodiments of the invention the housing may be configured so as to at least partially seal the ear canal of the user's ear.

In some embodiments of the invention the control signal may be used to define a target output for the loudspeaker.

In some embodiments of the invention the acoustic signal may comprise a reference signal.

The apparatus may be for providing an acoustic signal. For example, the apparatus may be an earphone.

According to various, but not necessarily all, embodiments of the invention there is provided a method comprising: providing an acoustic signal towards an ear drum from a first position; detecting an acoustic signal at a second position where the second position is displaced from the first position so that the second position is between the ear drum and the first position and using the detected acoustic signal to provide a control signal to a filter for filtering an input signal to a loudspeaker.

In some embodiments of the invention (described in the above paragraph) the detected acoustic signal may comprise a plurality of components including the provided acoustic signal and a signal reflected by an ear canal.

In some embodiments of the invention the detected acoustic signal may be used to give an indication of individual characteristics of a user's ear.

In some embodiments of the invention the method may further comprise detecting a signal at a third position where the third position is displaced from the first position such that, in use, the third position is between an environment external to a user's ear and the first position.

In some embodiments of the invention the feedback circuit may be used to control the acoustic signal provided by the loudspeaker.

In some embodiments of the invention the detected signals may also be used for active noise cancellation.

In some embodiments of the invention the control signal may be used to define a target output for the loudspeaker.

In some embodiments of the invention the provided acoustic signal may comprise a reference signal.

According to various, but not necessarily all, embodiments of the invention there is provided a computer program comprising computer program instructions configured to control an apparatus, the program instructions providing, when loaded into a processor; means for providing an acoustic signal towards an ear drum from a first position; means for detecting an acoustic signal at a second position where the second position is displaced from the first position so that the second position is between the ear drum and the first position and means for using the detected acoustic signal to provide a control signal to a filter for filtering an input signal to a loudspeaker.

In some embodiments of the invention there may also be provided a physical entity embodying the computer program as described above.

In some embodiments of the invention there may also be provided an electromagnetic carrier signal carrying the computer program as described above.

In some embodiments of the invention there may also be provided a computer program comprising program instructions for causing a processor to perform the method as described above.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1:
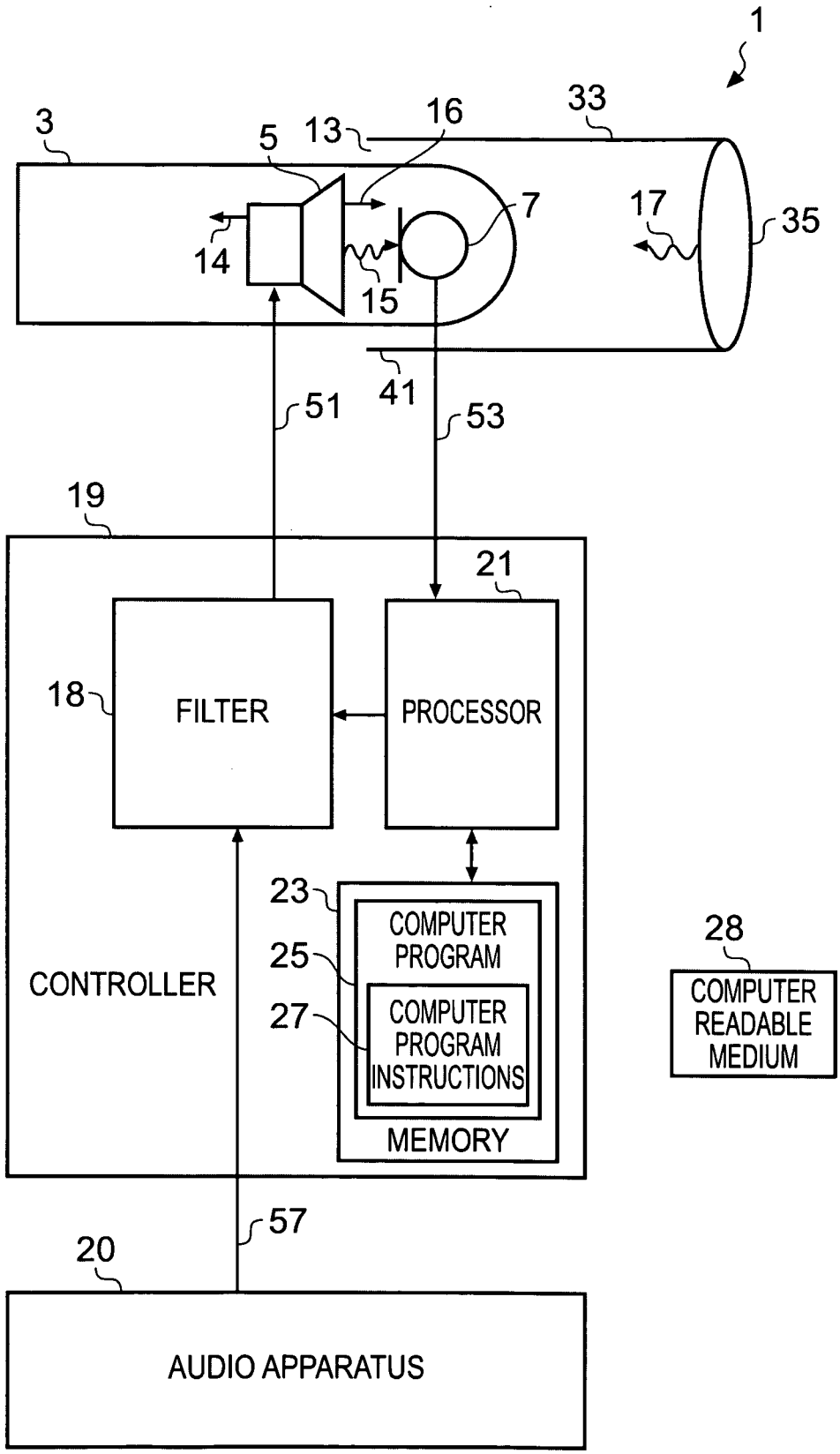
FIG. 1 illustrates an apparatus according to a first embodiment of the invention.

The Figures illustrate an apparatus 1, method and computer program 25, the apparatus 1 comprising: a housing 3 configured to be positioned in a user's external ear 37; a loudspeaker 5 located at a first position within the housing 3 and configured to provide an acoustic signal 15; a microphone 7 configured to detect an acoustic signal, located at a second position within the housing 3 a filter configured to filter an input signal provided to the loudspeaker; and a controller 19 configured to enable the acoustic signal 15 detected by the microphone 7 to be used to provide a control signal to the filter 18.

In the following description, unless expressly stated otherwise, the words "connect" and "couple" and their derivatives mean operationally connected or operationally coupled. It is to be appreciated that any number or combination of intervening components can exist including no intervening components.

FIG. 1 schematically illustrates an apparatus 1 according to a first embodiment of the invention. The apparatus 1 comprises a housing 3. In the embodiments illustrated in FIG. 1 a loudspeaker 5, and a microphone 7 are located within the housing 3. The apparatus 1 also comprises a controller 19.

Figure 2:
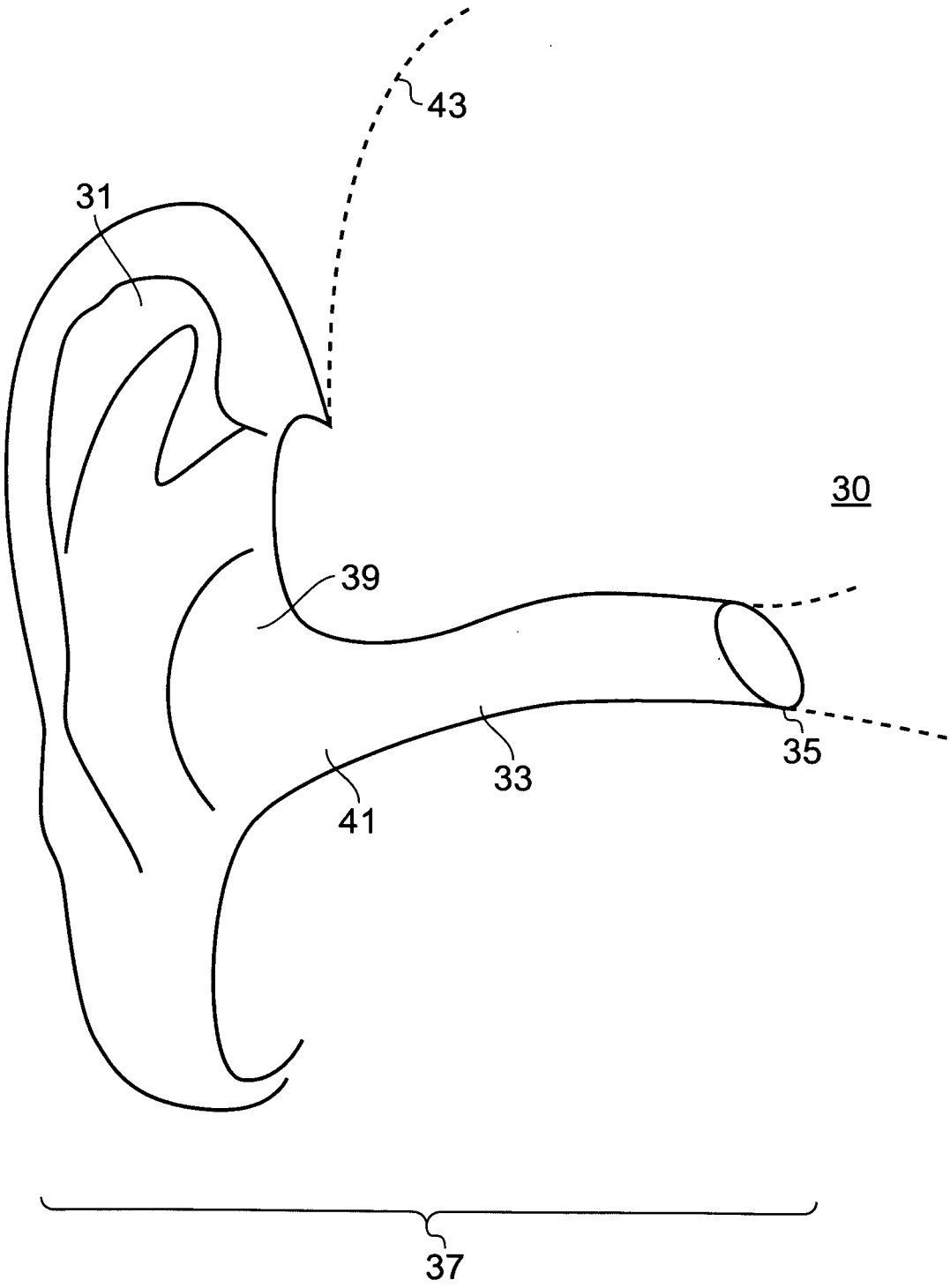
FIG. 2 illustrates an ear.

The housing 3 is configured to fit into the external ear 37 portion of a user's ear 30. FIG. 2 illustrates the respective portions of an ear 30. The external ear 37 comprises the pinna 31, the ear canal 33 and the ear drum 35. Acoustic signals incident on the ear drum 35 are transmitted to the inner ear which has not been illustrated in FIG. 2. The side of the users head is indicated by the dashed line 43.

In the embodiment illustrated in FIG. 1 the housing 3 is positioned in the outer portion 39 of the ear canal 33. In the illustrated embodiment the housing 3 is tapered so that, in use, a portion of the housing 3 extends into the inner portion 41 of the ear canal 33.

The housing 3 fits closely to the outer portion 39 of the ear canal 33. The housing 3 may fit in the outer portion 39 of the ear canal 33 so that the ear canal 33 is completely or partially sealed. In the embodiment illustrated in FIG. 1 the ear canal 33 is only partially sealed so a gap 13 is provided between the edge of the housing 3 and the ear canal 33. The size of the gap 13 may depend on a number of factors including the size and shape of the user's ear 30, the size and shape of the housing 3 and how the user has positioned the housing 3 within their ear 30.

The housing 3 may provide a protective barrier for the loudspeaker 5 and the microphone 7 and any other components located within the housing 3. The housing 3 may be waterproof to protect the components from fluid ingress. The housing 3 may be configured to withstand mechanical shocks.

A loudspeaker 5 is provided within the housing 3. The loudspeaker 5 may be any means which is configured to convert an electrical input signal 51 to an acoustic output signal 15. The loudspeaker 5 may comprise a transducer. In some embodiments of the invention the loudspeaker 5 may be an earpiece. The loudspeaker 5 is configured to receive an input signal 51 from the controller 19.

The loudspeaker 5 is located at a first position within the housing 3. The loudspeaker 5 is oriented such that the acoustic signal 15 produced by the loudspeaker 5 is provided in a first direction indicated by arrow 16. When the housing 3 is positioned in a user's external ear 37 the first direction is in the general direction in which the ear canal 33 extends towards the ear drum 35.

In the embodiment illustrated in FIG. 1 the apparatus 1 comprises a first microphone 7. The first microphone 7 may be any means for detecting an acoustic signal and converting the detected signal into an electrical signal.

In the illustrated embodiment the first microphone 7 is located at a second position within the housing 3. The second position is displaced from the first position in the first direction indicated by arrow 16. In the illustrated embodiment the first microphone 7 is located in front of the loudspeaker 5. When the housing 3 is positioned in the user's external ear 37 the first microphone 7 is located between the loudspeaker 5 and the ear drum 35. It is to be appreciated that in other embodiments of the invention the first microphone 7 may be located at a different position.

In the embodiment illustrated in FIG. 1 the first microphone 7 is located in the tapered portion of the housing 3 so that in use the first microphone 7 is located within the inner portion 41 of the ear canal 33.

As the first microphone 7 is located between the loudspeaker 5 and the ear drum 35 both the acoustic signals 15 provided by the loudspeaker and any reflected acoustic signals 17 from the ear canal 33 and ear drum 35 or formed acoustic signal are incident upon the first microphone 7. The microphone 7 may detect a signal which comprises a range of frequency components. Some of the frequency components may be provided by the loudspeaker 5 and/or reflected from the ear canal 33 and the ear drum 35. In some embodiments of the invention low frequency components of the detected signal may be formed between the housing 3 and ear drum 35. Furthermore, the signal detected by the microphone may comprise other components such as the user's own speech or other external sound sources.

In this embodiment, the first microphone 7 converts the detected signals 15, 17 into electrical signals and provides these as an input signal 53 to the controller 19. The input signal 53 may be provided to a processor 21 within the controller 19. In some embodiments of the invention the input signal 53 may also be provided as an input to a feedback circuit.

The controller 19 provides means for controlling the apparatus 1. In the illustrated embodiment the controller 19 comprises a processor 21 and a memory 23. In the illustrated embodiment the controller 19 also comprises a filter 18. In some embodiments of the invention the filter 18 may be part of a feedback circuit.

In the embodiment illustrated in FIG. 1 the controller 19 is illustrated outside the housing 3 for the purposes of clarity. In some embodiments of the invention the controller 19 may be located within the housing 3. In other embodiments of the invention the controller 19 may be located outside of the housing 3.

The controller 19 may be implemented using instructions that enable hardware functionality, for example, by using executable computer program instructions 27 in a general-purpose or special-purpose processor 21 that may be stored on a computer readable storage medium 29 (e.g. disk, memory etc) to be executed by such a processor 21.

The memory 23 stores a computer program 25 comprising computer program instructions 27 that control the operation of the apparatus 1 when loaded into the processor 21. The computer program instructions 27 provide the logic and routines that enables the first apparatus 1 to perform the methods illustrated in FIG. 3. The processor 21 by reading the memory 23 is able to load and execute the computer program 25.

The computer program instructions 27 may provide computer readable program means for providing an acoustic signal 15 towards an ear drum 35 from a first position; means for detecting an acoustic signal 15 at a second position where the second position is displaced from the first position so that the second position is between the ear drum 35 and the first position and means for using the detected acoustic signal to provide a control signal to a filter 18 for filtering an input signal 51 to a loudspeaker 5.

The computer program 25 may arrive at the apparatus 1 via any suitable delivery mechanism 28. The delivery mechanism 28 may be, for example, a computer-readable storage medium, a computer program product, a memory device such as a flash memory, a record medium such as a CD-ROM or DVD, an article of manufacture that tangibly embodies the computer program 25. The delivery mechanism 28 may be a signal configured to reliably transfer the computer program 25. The apparatus 1 may propagate or transmit the computer program 25 as a computer data signal.

Although the memory 23 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (e.g. Von Neumann)/parallel architectures but also specialized circuits such as field-programmable gate arrays (FPGA), application specific integration circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device.

The controller 19 is configured to receive an input signal 57 from an audio apparatus 20. The audio apparatus 20 may be any means which produces an audio output. For example, it may be a cellular mobile telephone and the input signal 57 received by the controller 19 may correspond to speech which is part of a telephone conversation. In other embodiments the audio apparatus 20 may be an apparatus configured to play stored audio files. The stored audio files may be pure audio files, for example, music files or video files which comprise both audio information and image information.

The input signal 57 may arrive at the controller 19 via any suitable communication link. For example the input signal 57 may be received over a wired connection or a wireless connection such as a Bluetooth or Wireless local area network (WLAN) link.

The controller 19 converts the received input signal 57 to an output signal 51 which is provided to the loudspeaker 5. The controller 19 may convert the input signal 57 to the output signal 51 by passing the signal through the filter 18. The processor 21 may be used to control the filter 18 which is applied to the output signal 51.

As mentioned above, the controller 19 also receives an input signal 53 from the microphone 7. The input signals 53 may be provided to the processor 21. As the microphone 7 detects the reflected signals 17 this provides a measure of the response of a system comprising the ear 30 and the apparatus 1. Therefore the input signal 53 provided by the microphone 7 provides feedback to the controller 19 of the response of the system. The signal 53 may be provided to the processor 21 which may be configured use the feedback to control the filter 18 and so control the output signal 51 provided to the loudspeaker 5.

The loop comprising the output signal 51 provided to the loudspeaker 5, the input signal 53 from the microphone 7, the processor 21 and the filter 18 may form a feedback circuit.

Figure 3:
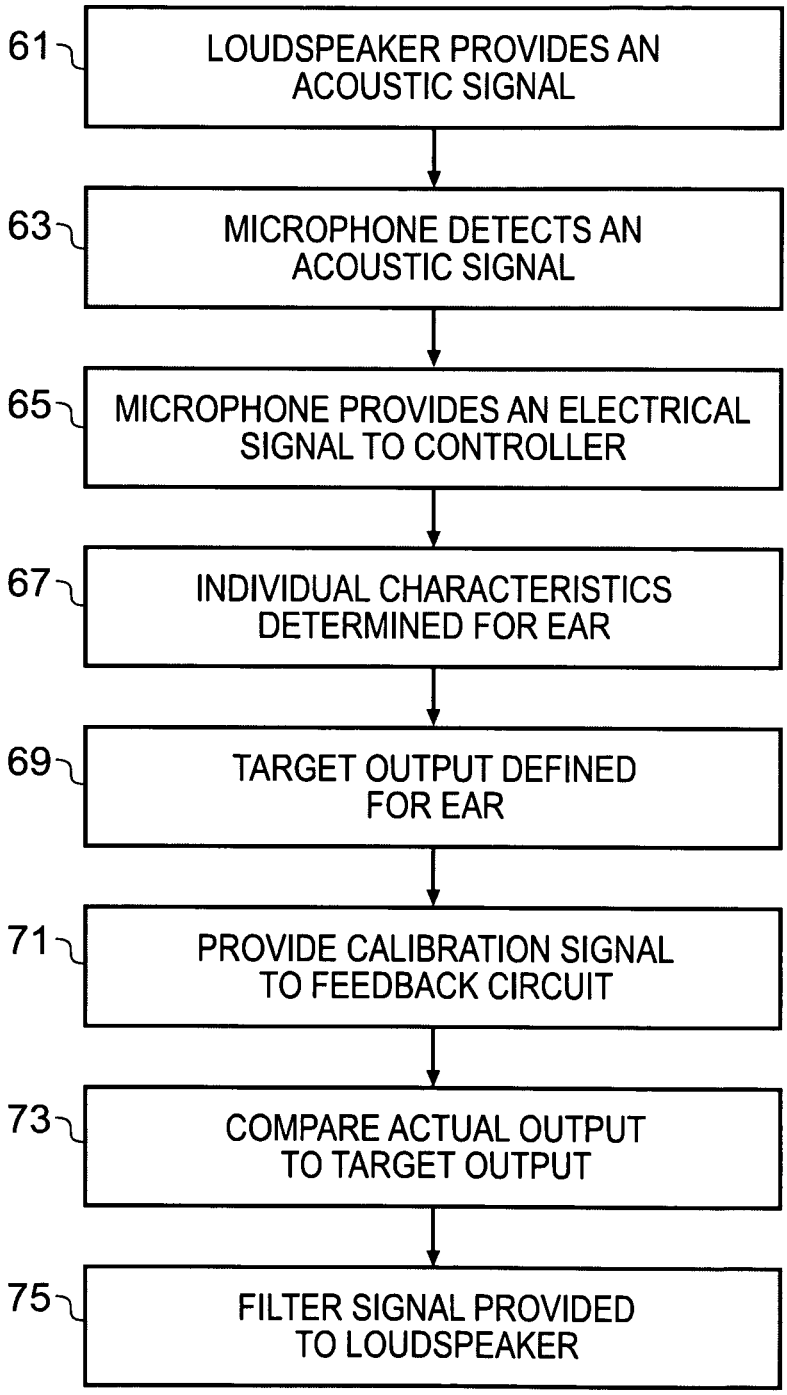
FIG. 3 illustrates a flow chart showing method blocks of embodiments of the invention.

A method of using the apparatus 1 according to embodiments of the invention is illustrated in FIG. 3.

At block 61 the controller 19 controls the loudspeaker 5 to provide an acoustic signal 15. The acoustic signal 15 may comprise a reference signal, for example it may be a white noise signal a weighted noise signal such as pink noise or a signal comprising a sequence of known frequencies at known amplitudes. In other embodiments of the invention the signal 15 may be any acoustic signal, for example it may be music corresponding to a stored audio file or it may be speech corresponding to a telephone conversation. The acoustic signal 15 may comprise any frequencies from the range of audible frequencies.

As the ear drum and the ear canal 33 are not perfect transmitters some of the acoustic signal is reflected by the ear drum 35 and the ear canal 33.

At block 63 the microphone 7 detects an acoustic signal and converts this to an electrical signal 53 which is provided to the controller 19. The acoustic signal detected by the microphone 7 provides an indication of the acoustic characteristics of the ear canal 33 and the amount of leakage at the ear canal 33 entrance. The detected acoustic signal comprises a plurality of components. Some of the components are the components corresponding to the acoustic signal 15 provided by the loudspeaker 5 and other components correspond to the reflected signal 17 from the ear drum 35 and the ear canal 33. The acoustic signal detected by the microphone 7 is dependent upon the acoustic properties of the ear drum 35 and the ear canal 31 and so will be different for each user. The acoustic signal detected by the microphone 7 will also be dependent on the way in which the apparatus 1 is located within the user's ear 30.

At block 65 the microphone 7 converts the detected acoustic signal into an electrical signal 53 and provides the electrical signal 53 to the controller 19.

At block 67 the controller 19 uses the input signal 53 received from the microphone 7 to determine individual characteristics of the ear 30. For example, the controller 19 may process the input signal 53 to determine the frequency response of the system comprising the ear 30 and the apparatus. The frequency response is unique to each user's ears and also each ear of each user because it is dependent on the size and shape of the ear canal 33. The frequency response is also dependent on the way in which the housing 3 is positioned within the external ear 37. For example, it will be dependent upon the size of the gap 13 between the housing 3 and the external ear 37. The way the housing 3 is positioned in the external ear 37 may be different every time the apparatus 1 is used. Therefore the frequency response of the system may also be different every time the apparatus 1 is used. Also the way the housing 3 is positioned in the external ear 37 may vary while the apparatus 1 is in use, for example the user may adjust the position of the apparatus 1 in their ear 30. This means that the frequency response of the system may also change while the apparatus 1 is in use.

In some embodiments of the invention the controller 19 may also be able to use the input signals provided by the microphone 7 to determine physical dimensions of the ear canal 33. For example, by determining the delay in the detection of the reflected signal 17 compared to the acoustic signal 15 the controller 19 may be able to determine the length of the ear canal 33.

At block 69 the controller 19 uses the determined individual characteristics of the ear 30 to determine a target output for the loudspeaker 5. The target output is an output which provides a good level of performance of the apparatus for the user. In embodiments of the invention the individual characteristics of the ear 30, which were determined at block 69, are used so that the target output may be personalized for the user.

The controller 19 may use software implemented algorithms to determine the target output of the ear 30. The algorithms used to perform this process may be comprised in the computer program 25 and stored in the memory 23.

Once the target output has been determined, the controller 19, at block 71, uses the individually determined target output to provide a control signal to the filter 18. The individually determined target output may be unique to the user's ear 30 and also the way the apparatus 1 is positioned in the user's ear 30. The individually determined target output may be different for each user of the apparatus 1 and may be different each time the apparatus 1 is used.

Also in some embodiments of the invention the individually determined target output may change during use, for example, if the user adjusts the position of the apparatus 1 within their ear 30. The control signal controls the filter 18 which is used to filter the output signal 51.

In some embodiments of the invention the filter 18 may be part of a feedback circuit. In such embodiments of the invention the control signal may also calibrate the feedback circuit because it determines what the output of the feedback circuit is. The output signal 51 is filtered so that the output of the loudspeaker 5 is closer to the individually determined target output.

Once the control signal has been provided to the filter 18 the output signal 51 is filtered. In some embodiments of the invention the input signal 53 received by the controller 19 from the microphone 7 after the filtering has taken place are compared with the target output. If there is any deviation from the target response the controller will provide a further signal, at block 75, to the filter. The further signal controls the filter to modify the output signal 51 bring the response closer to the target response.

Embodiments of the invention provide the advantage that the filter is calibrated so that it is optimized for use with an individual ear. This means that the apparatus 1 may be configured so that every user of the apparatus 1 hears a good signal quality irrespective of the individual characteristics of their ear 30 or the way in which they have inserted the housing 3 into their ear 30.

The blocks illustrated in FIG. 3 may represent steps in a method and/or sections of code in the computer program 25. The illustration of a particular order to the blocks does not necessarily imply that there is a required or preferred order for the blocks and the order and arrangement of the block may be varied. For example, in some embodiments of the invention blocks 73 and 75 may be repeated many times while the apparatus 1 is in use. Furthermore, it may be possible for some steps to be omitted.

It is to be appreciated that, in some embodiments of the invention, the controller 19 may be configured to deconvolute the signal into the separate components and use the separate components to determine individual characteristics of the ear 30.

In some embodiments of the invention the signal detected by the microphones may comprise acoustic signals from other sources, for example the user's own speech.

Also in the above described embodiments the apparatus comprises one loudspeaker and at least one microphone. In other embodiments of the invention two loudspeakers and at least two microphones may be provided and are accordingly integrated in separate housings so that a user may position a loudspeaker and at least one microphone in each ear. In such embodiments a single controller may be configured to control both of the loudspeakers and microphones or a separate controller may be provided for each loudspeaker and microphone.

In the illustrated embodiment blocks 67, 69 and 73 may be carried out by the processor 21.

Figure 4:
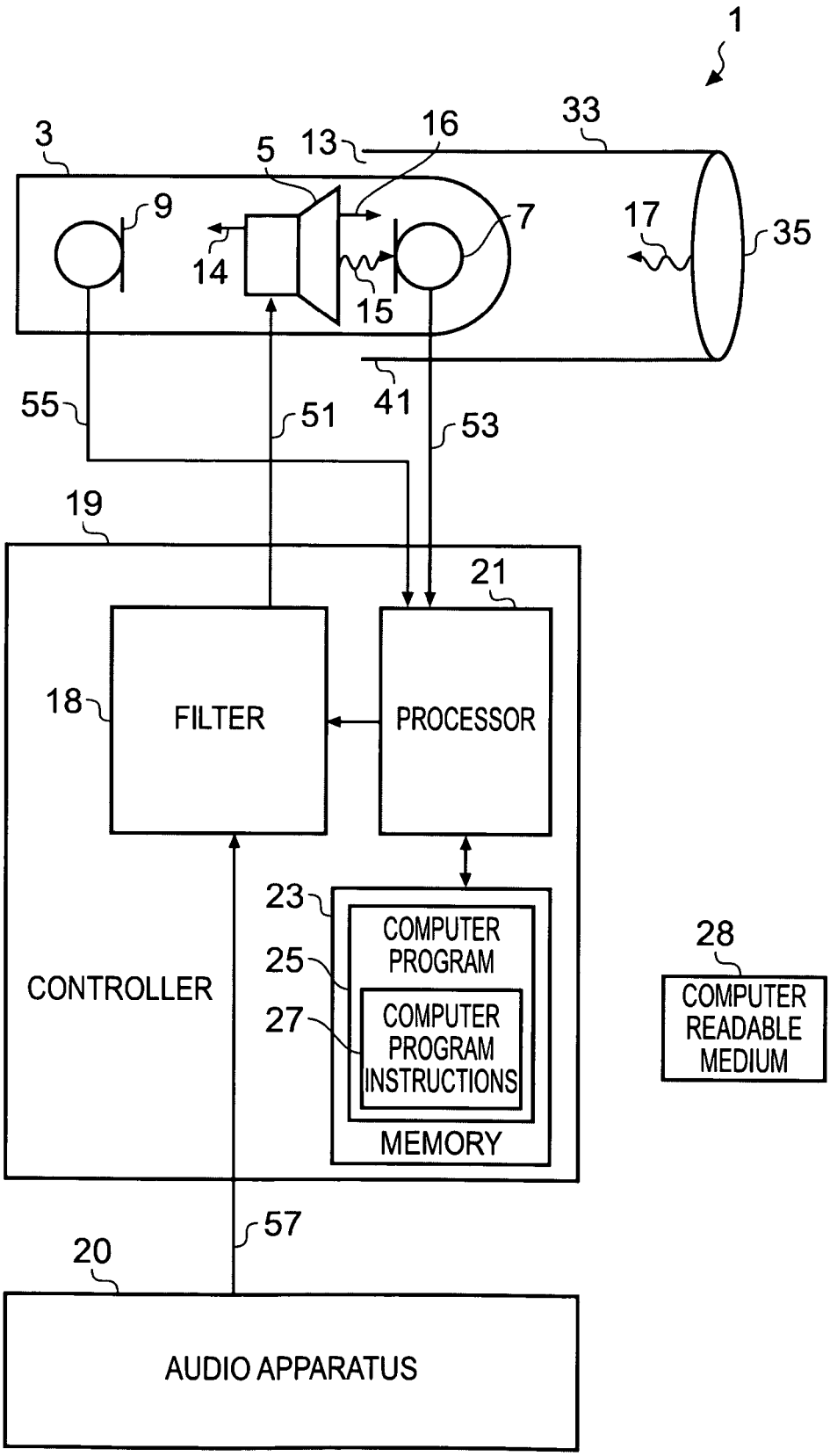
FIG. 4 illustrates an apparatus according to a second embodiment of the invention.

FIG. 4 illustrates an apparatus 1 according to a second embodiment of the invention. This second embodiment is similar to the first embodiment and operates in a similar manner as described above, except that in this embodiment a second microphone 9 is also provided within the housing 3. The second microphone 9 is located at a third position. In the illustrated embodiment the third position is displaced from the first position in a direction generally opposite to the first direction as indicated by arrow 14. In other embodiments of the invention the second microphone 9 may be in any location within the housing 3 so that in use the second microphone 9 is close to the entrance of the ear canal 33. The second microphone 9 is located behind the loudspeaker 9 so that in use the second microphone 9 is located between the loudspeaker 5 and the external environment.

The second microphone 9 also detects acoustic signals. The acoustic signals may comprise signals from the external environment, signals from the loudspeaker 15 and reflected acoustic signals 17 from the ear canal 33 and the ear drum 35. For example the microphone 9 may be configured to detect background or ambient noise around the user.

The second microphone 9 converts the detected signals into electrical signals and provides these as an input signal 55 to the controller 19. The input signal 55 may be provided to a processor 21 within the controller 19. In some embodiments of the invention the input signal 55 may also be provided as an input to a filter or a feedback circuit. The input signal 55 may be used as an input for an adaption algorithm.

In some embodiments of the invention both of the microphones 7, 9 may also be used to provide other feedback signals such as active noise cancellation (ANC). For example the first microphone 7 may be used for ANC (feedback) and the second microphone 9 may be used for ANC (feedforward). This may be used to provide improved signal quality to a user by cancelling out the noise of the surrounding environment. This is advantageous because it may use the same microphones 7, 9 which are used to determine the individual characteristics of the ear 30 and so would not require any further components within the housing 3.

The microphones 7, 9 may also be configured for other uses. For example, the first microphone 7 may be configured for use in loudspeaker response linearization or occlusion effect cancellation. The second microphone may be configured for use in hear-trough, speech capture, binaural recording, occlusion effect cancellation or to enable the apparatus to be used as a hearing aid.

Although embodiments of the present invention have been described in the preceding paragraphs with reference to various examples, it should be appreciated that modifications to the examples given can be made without departing from the scope of the invention as claimed.

For example, in some embodiments of the invention the target output may also be dependent upon the type of input being provided. For example a first frequency response may be preferred if the acoustic signal corresponds to speech and a different response may be preferred if the acoustic signal comprises music. The response preferred may also depend upon the type of music which comprises the acoustic signal.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a housing configured to be positioned in a user's ear;

a loudspeaker located at a first position within the housing and configured to provide an acoustic signal;

a microphone located at a second position within the housing configured to detect an acoustic signal wherein the second position is different from the first position so that the microphone is positioned between the loudspeaker and a ear drum, wherein the acoustic signal provides an indication of acoustic characteristics of the user's ear and/or an amount of leakage between the housing and the user's ear;

a filter configured to filter an input signal provided to the loudspeaker; and a controller configured to use an electrical signal provided by the microphone, based on the acoustic signal, to be used to provide a control signal for controlling the filter to determine an output for the loudspeaker.

2. An apparatus as claimed in claim 1 wherein the microphone is configured to convert the detected acoustic signal into an electrical signal and provide the electrical signal to the controller.

3. An apparatus as claimed in claim 2 wherein the acoustic signal detected by the microphone comprises a plurality of frequency components from the audible frequency range.

4. An apparatus as claimed in claim 1 wherein the controller is configured to use the electrical signal provided by the microphone to give an indication of individual characteristics of the user's ear.

5. An apparatus as claimed in claim 1 wherein the controller is located within the housing.

6. An apparatus as claimed in claim 1 wherein the apparatus comprises a further microphone configured to detect an acoustic signal located at a third position where the third position is displaced from the first position such that, in use, the further microphone is positioned between the loudspeaker and an environment external to the user's ear.

7. An apparatus as claimed in claim 1 wherein the apparatus comprises a feedback circuit which is used to control the acoustic signal provided by the loudspeaker.

8. An apparatus as claimed in claim 7 wherein the output signal of the microphone is provided to the feedback circuit.

9. An apparatus as claimed in claim 1 wherein the controller is also configured to use signals detected by the microphone for active noise cancellation.

10. An apparatus as claimed in claim 1 wherein the housing is configured so as to at least partially seal the ear canal of the user's ear.

11. An apparatus as claimed in claim 1 wherein the acoustic signal comprises a reference signal.

12. An apparatus as claimed in claim 1 wherein the housing is configured to be positioned in a user's external ear comprising an outer ear, an ear canal, and the eardrum.

13. A method comprising:

providing an acoustic signal towards an ear drum from a first position;

detecting an acoustic signal at a second position where the second position is displaced from the first position so that a microphone is positioned between a loudspeaker and the ear drum and the first position;

using the detected acoustic signal to provide a control signal to a filter for filtering an input signal and outputting a target output to the loudspeaker, wherein the target output is unique to a user's ear and the position of an apparatus within the user's ear.

14. A method as claimed in claim 13 wherein the detected acoustic signal comprises a plurality of frequency components from the audible frequency range.

15. A method as claimed in claim 14 wherein the detected acoustic signal is used to give an indication of individual characteristics of a user's ear.

16. A non-transitory computer readable medium storing a program of machine-readable instructions for causing a processor to perform the method of claim 13.

17. A non-transitory computer readable medium storing a program of machine-readable instructions executable by a digital processing apparatus of a computer system to perform operations for controlling computer system actions, the operations comprising:

providing an acoustic signal towards an ear drum from a first position;

detecting an acoustic signal by a microphone at a second position where the second position is displaced from the first position so that the microphone is between a loudspeaker and the ear drum; and using the detected acoustic signals to provide a control signal to a filter for filtering an input signal and outputting a target output to the loudspeaker, wherein the defined target output is unique to a user's ear and the position of the apparatus within the user's ear.

18. A physical entity embodying the program of machine-readable instructions as claimed in claim 17.

19. An electromagnetic carrier signal carrying the program of machine-readable instructions as claimed in claim 17.

* * * * *